US007566389B2

(12) United States Patent
Shimamune et al.

(10) Patent No.: US 7,566,389 B2
(45) Date of Patent: Jul. 28, 2009

(54) ELECTRODE

(75) Inventors: Takayuki Shimamune, Tokyo (JP); Erik Zimmerman, Ljungaverk (SE); Christer Andreasson, Ljungaverk (SE)

(73) Assignee: Akzo Nobel N.V., Arnhem (NL)

( * ) Notice: Subject to any disclaimer, the term of this patent is extended or adjusted under 35 U.S.C. 154(b) by 518 days.

(21) Appl. No.: 10/960,632

(22) Filed: Oct. 8, 2004

(65) Prior Publication Data

US 2005/0183952 A1 Aug. 25, 2005

Related U.S. Application Data

(60) Provisional application No. 60/509,247, filed on Oct. 8, 2003.

(51) Int. Cl.
*C25B 11/08* (2006.01)

(52) U.S. Cl. ..... 204/290.11; 204/290.12; 204/290.14; 204/290.01

(58) Field of Classification Search ..... 204/290.01, 204/290.11, 290.12, 290.14
See application file for complete search history.

(56) References Cited

U.S. PATENT DOCUMENTS

| | | | | |
|---|---|---|---|---|
| 3,720,590 | A | 3/1973 | DeWitt et al. | |
| 3,773,554 | A | 11/1973 | Lee | |
| 4,070,504 | A | 1/1978 | Bianchi | |
| 4,443,317 | A | 4/1984 | Murakami | |
| 5,503,663 | A | 4/1996 | Tsou | |
| 5,587,058 | A | 12/1996 | Gorodetsky et al. | |
| 6,217,729 | B1 * | 4/2001 | Zolotarsky et al. ..... | 204/290.08 |
| 6,258,461 | B1 | 7/2001 | Baldi et al. | |

FOREIGN PATENT DOCUMENTS

| | | |
|---|---|---|
| EP | 0 437 178 A1 | 7/1991 |
| EP | 0 715 002 | 6/1996 |
| EP | 0 867 527 | 9/1998 |
| GB | 2 096 173 A | 10/1982 |
| JP | 57-171571 | 10/1982 |
| JP | 3-163967 | 7/1991 |
| JP | 5-209299 | 8/1993 |
| JP | 7-90665 | 4/1995 |
| JP | 2000-345041 | 12/2000 |

OTHER PUBLICATIONS

Burke et al, "Cyclic Voltammetry as a Technique . . . ", Electroanal. Chem, vol. 96 (1979), pp. 19-27.
Savinell et al, "Electrochemically Active Surface Area", J. Electrochem. Soc., vol. 137, No. 2, Feb. 1990.
Canadian IPO Office Action for Canadian Patent application 2,541,311 relating to case U.S. Appl. No. 10/960,632 dated Jul. 23, 2009.
Translation of Japanese IPO Office Action for JP 2006-532238 relating to case U.S. Appl. No. 10/960,632 dated Nov. 26, 2008.
Patent Abstracts of Japan abstracting JP 3-163967.
Patent Abstracts of Japan abstracting JP 57-171571.
Patent Abstracts of Japan abstracting JP 2000-345041.
Patent Abstracts of Japan abstracting JP 05-209299.
Patent Abstracts of Japan abstracting JP 7-90665.

* cited by examiner

*Primary Examiner*—Bruce F. Bell
(74) *Attorney, Agent, or Firm*—David J. Serbin; Robert C. Morriss

(57) ABSTRACT

The present invention relates to a method of preparing an electrode comprising providing an electrode substrate, depositing on said electrode substrate a first substantially aqueous coating solution comprising precursors of a valve metal oxide and of at least two platinum group metal oxides, treating the first coating solution to provide a first metal oxide coating layer on the electrode substrate, depositing on said first coating layer a second substantially organic coating solution comprising precursors of a valve metal oxide and at least one platinum group metal oxide, wherein at least one of the precursors is in organic form, treating said second coating solution to provide a second metal oxide coating layer on the first coating layer. The invention also relates to an electrode obtainable by said method, and the use thereof.

18 Claims, No Drawings

ELECTRODE

This application claims benefit of Provisional Application No. 60/509,247, filed on Oct. 8, 2003.

The present invention relates to an electrode, a method of preparing the electrode, and the use thereof.

BACKGROUND OF THE INVENTION

Electrodes coated with titanium oxide, iridium oxide, and ruthenium oxide are commercially used today in electrolytic cells. Such electrodes can be prepared in accordance with EP 715002 B1 disclosing a method wherein an anhydrous solvent comprising precursors of mixed metal oxides are deposited on a substrate to form an electrocatalytic oxide coating. However, electrodes produced by this method have a fairly low activity resulting in ohmic losses and high cell voltages in electrolytic cells, which leads to increased electric energy consumption. A further problem of conventional electrodes are their relatively short service life. The present invention intends to solve these problems.

THE INVENTION

The present invention relates to a method of preparing an electrode comprising providing an electrode substrate, depositing on said electrode substrate a first substantially aqueous coating solution comprising precursors of a valve metal oxide and of at least two platinum group metal oxides, treating the first coating solution to provide a first metal oxide coating layer on the electrode substrate, depositing on said first coating layer a second substantially organic coating solution comprising precursors of a valve metal oxide and of at least one platinum group metal oxide, wherein at least one of the precursors is in organic form, treating said second coating solution to provide a second metal oxide coating layer on the first coating layer.

The electrode substrate can be any valve metal or valve metal surfaced substrate such as titanium, tantalum, zirconium, niobium, tungsten, silicon or alloys thereof, preferably titanium. Valve metals are known as film-forming metals having the property, when connected as an electrode in the electrolyte in which the coated electrode is expected to operate, of rapidly forming a passivating oxide film which protects the underlying metal from corrosion by the electrolyte. The substrate can have any suitable shape such as a rod, tube, woven or knitted wire, perforated or non-perforated plate, louver, or mesh, e.g. an expanded mesh. Titanium or other valve metal clad on a conducting metal core or substrate can also be used. Preferably, the electrode substrate is perforated or has the shape of a mesh having openings with a diameter from about 1 to about 10, more preferably from about 2 to about 5 mm. Preferably, the electrode substrate is roughened using chemicals means such as etching, e.g. acid etching, or mechanical such as blasting, e.g. sand blasting, grit blasting by means of e.g. aluminium oxide grits. It is preferred that the substrate surface has a roughness $R_a$ from about 2 to about 12, more preferably from about 3 to about 6, and most preferably from about 4 to about 5 μm as measured using the SURFTEST 212 surface roughness tester (Mitutoyo, Japan). After the surface of the substrate has been roughened, it may be subjected to thermal oxidation by heating the substrate surface at an elevated temperature in an oxygen containing atmosphere for about 1 to about 3 hours. The temperature of such treatment is preferably from about 350 to about 600, more preferably from about 400 to about 500° C.

The precursors of the platinum group metal oxides dissolved in the first coating solution preferably comprise at least two water-soluble compounds of platinum, iridium, palladium, rhodium, osmium, and ruthenium, more preferably ruthenium and at least one of iridium, palladium, platinum, rhodium, and osmium, and most preferably ruthenium and iridium. Suitable precursors include e.g. $RuCl_3$, $H_2RuCl_8$, $IrCl_3$, and mixtures thereof. Preferably, the precursors are soluble also in acidified aqueous solutions. Suitable valve metal oxide precursors include water-soluble compounds of aluminium, zirconium, bismuth, tungsten, niobium, titanium, silicon and tantalum, preferably titanium, e.g. $TiCl_4$.

Preferably, the first coating solution is acidified, suitably by hydrochloric acid and/or other mineral acids to a pH of from about 0 to about 5, more preferably from about 0 to about 2.

Suitably, at least about 70, preferably at least about 90, and most preferably at least about 95 volume percent of the solvent in the substantially aqueous coating solution is comprised of water.

The first coating solution is suitably deposited on the substrate by applying the solution on the electrode substrate, preferably until the total loading of the first layer is from about 0.5 to about 10, more preferably from about 1 to about 6, and most preferably from about 1.5 to about 3 g metal/$m^2$. The process of depositing the coating solution can be repeated in order to obtain a thicker layer having the desired metal oxide content. It is desirable to let the coating air dry after each repetition at a temperature from about 20 to about 70, preferably from about 20 to about 50° C. The drying can take from about 10 to about 20 minutes. The coating solution can then be heat treated at a temperature from about 300 to about 600, preferably from about 450 to about 550° C. for suitably about 10 to about 30 minutes in order to convert the precursors to their corresponding metal oxides.

Suitable platinum group oxide precursors of the second coating solution include organic compounds, such as organic salts and acids of ruthenium, osmium, rhodium, iridium, palladium, and platinum, and mixtures thereof, preferably ruthenium and optionally at least one of iridium, palladium, rhodium, and osmium, and most preferably ruthenium and iridium. Suitable valve metal oxide precursors can include e.g. organic compounds such as organic salts and acids thereof include water-soluble compounds of aluminium, zirconium, bismuth, tungsten, niobium, titanium, silicon and tantalum, preferably titanium. However, it is sufficient that at least one of the precursor compounds is present in its organic form, i.e. includes organic compounds such as organic metal salts or acids such as e.g. titanium alcoxide, tetrabuthyl titanate, and/or tetrapentyl titanate.

It has been found that coating solutions for providing the second or outermost coating layer containing at least one precursor in organic form in a substantially organic coating solution results in an electrode having increased activity when deposited on the first coating layer.

Suitably, at least about 70, preferably at least about 90, and most preferably at least about 95 volume percent of the solvent in the substantially organic coating solution is comprised of organic solvent.

Preferred organic solvents of the second coating solution include alcohols, preferably lower alcohols, more preferably acidified anhydrous, lower alkyl alcohols having from about 3 to about 5 carbons atoms, such as 1-buthanol, 1-propanol, 2-propanol, 1-pentanol and 2-pentanol and 3-methyl-2-butanol. The second coating solutions preferably include a concentrated acid, such as a mineral acid, e.g. hydrochloric acid adjusting the pH to from about −1 to about 5, preferably from about −1 to about 2.

The second coating solution is suitably applied to the obtained first coating layer until the total metal loading of the second layer is from about 1 to about 10, preferably from about 1.5 to about 3.5 g metal/$m^2$. The deposition process can be repeated in order to obtain a thicker second coating layer or a further coating layer on the second coating layer. In industrial use, the loading of the second coating solution is preferably from about 1 to about 10, most preferably from about 1.5 to about 3.5 g metal/$m^2$. Preferably, the second coating solution is air dried and heat treated in the same way as the first coating solution so as to form the second coating layer.

According to one preferred embodiment, precursors of the two platinum metal oxides are dissolved in the first coating solution in a mole ratio of about 1:2 to about 2:1, preferably from about 2:3 to about 3:2. According to one preferred embodiment, at least two precursors of platinum metal oxides are dissolved in the second coating solution in the same mole ratio as in the first coating solution. According to one preferred embodiment, precursors of the platinum and valve metal oxides are dissolved in the coating solutions in a mole ratio of valve metal to platinum metal(s) of about 1:2 to about 2:1, preferably from about 4:5 to about 1:1.

According to one preferred embodiment, precursors of iridium and ruthenium oxides are dissolved in at least one of the first and/or the second coating solutions in a mole ratio of about 1:2 to about 2:1, preferably from about 2:3 to about 3:2. According to one preferred embodiment, precursors of titanium; iridium and/or ruthenium are dissolved in the coating solutions in a mole ratio of titanium to iridium and ruthenium of about 1:2 to about 2:1, preferably from about 4:5 to about 1:1.

Each coating solution is suitably deposited by immersion of the electrode substrate in the coating solution or by means of other suitable methods such as spraying, e.g. electrostatic spraying, rolling or brush painting. Even though a process providing two layers (with the defined coatings) is preferred, further layers may also be adhered.

The invention also relates to an electrode obtainable by the method as disclosed herein.

The invention also relates to an electrode comprising an electrode substrate, a first coating layer having a charge/projected area from about 10 to about 200, preferably from about 25 to about 200, and most preferably from about 25 to about 190 mC/$cm^2$ (mCoulomb/$cm^2$), said first coating layer comprising a valve metal oxide and at least two platinum group metal oxides deposited on said electrode substrate, and a second coating layer having a charge/projected area from about 210 to about 1000, more preferably from about 250 to about 1000, and most preferably from about 300 to about 800 mC/$cm^2$, said second layer comprising a valve metal oxide and at least one platinum group metal oxide deposited on the first coating layer.

The charge/projected area was measured by an electrodouble layer measurement with cyclic voltammograms in sulphuric acid. The measuring condition of the cyclic voltammograms was 50 mV/second at a sweep rate in the range of 0.3 to 1.1V (vs. RHE (Reversible Hydrogen Electrode)) in 0.5M sulphuric acid. The measured values in mC/$cm^2$ are proportional to the active specific surface area of the electrodes. More information about this method can be found in L. D. Burke et al, Electroanal. Chem. 96(1976) 19-27 and R. F. Savinell et al, J. Electrochem. Soc. 137(1990) 489-494.

It has been found that an electrode according to the invention shows a superior activity while providing higher stability and longer service life in view of existing electrodes.

Preferably, the electrode substrate is as described herein. Particularly, the electrode substrate is suitably perforated or has the shape of a mesh having openings with a diameter from about 1 to about 10, more preferably from about 2 to about 5 mm. It has been found that the electrodes with openings within the defined ranges when immersed in an operated cell produce small bubbles of evolved gas, which in turn results in an increased homogeneous current distribution and lower ohmic loss, particularly in a membrane cell.

The coating layers of the electrode may comprise platinum group metal oxides, such as oxides of iridium, palladium, rhodium, osmium, and ruthenium, preferably oxides of ruthenium and at least one of iridium, rhodium, osmium, more preferably oxides of ruthenium and iridium. The coating layers also comprise at least one valve metal oxide such as an oxide of titanium, tantalum, zirconium, niobium, tungsten, and silicon, preferably titanium.

Preferably, the roughness $R_a$ of the electrode is from about 2 to about 12, more preferably from about 3 to about 6, and most preferably from about 4 to about 5 μm.

The metal oxide layers preferably contain from about 40 to about 70 mole percent counted as valve metal, preferably as tantalum and/or titanium, from about 20 to about 30 mole percent of ruthenium oxide counted as ruthenium, and from about 10 to about 30 mole percent of another platinum group metal oxide counted as metal. The oxide coating on the electrode substrate is also effective in increasing the service life of the electrode by retarding the corrosion of the platinum group metals.

Even though a process providing two layers (with the defined coatings) is preferred, further layers optionally with same or similar chemical composition may also be adhered.

The invention also relates to the use of the electrode in an electrolytic cell. Preferably, the electrode is used as an anode, preferably as a dimensionally stable anode, particularly in an ion membrane cell for the production of e.g. alkali metal hydroxide, particularly sodium hydroxide.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. While the examples here below provide more specific details of the reactions, the following general principles may here be disclosed. The following example will further illustrate how the described invention may be performed without limiting the scope of it.

All parts and percentages refer to part and percent by weight, if not otherwise stated.

EXAMPLE 1

A titanium expanded mesh having a thickness of 1 mm and length and width of 80 and 24 mm respectively was used as electrode substrate after having been degreased and pickled in boiling hydrochloric acid. A first coating solution was deposited on the substrate having a molar ratio of Ti:Ru:Ir of 2.1:1, in which the total Ir+Ru concentration was 50 g/l. The solution was prepared by dissolving ruthenium trichloride, iridium trichloride, and titanium tetrachloride in a hydrochloric acid based solution. The solution was then dried at 60° C. followed by thermal decomposition at 460° C. for 10 minutes. This deposition step was repeated three times. A second coating solution was then prepared by mixing hexachloro ruthenic acid and hexachloro iridic acid into a titanium solution comprising tetrabuthyl ortho titanate in n-propyl alcohol. 10 volume percent of HCl was added to the alcohol solution; The molar ratio of Ti:Ru:Ir was 2,1,1. The total Ir+Ru concentration was 30 g/l. The deposition and thermal decomposition of the second coating solution on the substrate was made in the same way as the first coating solution. The obtained electrode sample was then stabilised at 520° C. for 60 minutes. The chlorine evolution potential at 90° C. in a 300 g/l NaCl solution was tested at pH 2 for the electrode (used as anode) and for a comparative electrode produced in the same way as the first coating layer but with six repetitions instead of three. The current density was 40 A/dm$^2$. Table 1 below show-s the difference between the two electrodes. An accelerated life test was also performed in a $Na_2SO_4.10H_2O$ 250 g/l electrolyte at 60° C. at a pH of 2. The current density was 50A/d $^2$. The electrodouble layer measurement by cyclic voltammograms was performed in 0.5M sulphuric acid. Measuring conditions were 0.3 to 1.1V vs. RHE at a sweep rate of 50 mV/second.

TABLE 1

| Sample | $Cl_2$ evolution potential (V vs NHE) | Accelerated life (hours at 50 A/dm$^2$) | Cyclic voltammograms of the second (top) coating layer (mC/cm$^2$) |
|---|---|---|---|
| Electrode according to invention | 1.36 | 285 | 410 |
| Comparative electrode | 1.38 | 195 | 190 |

As can be seen from table 1, a lower $Cl_2$ evolution potential is obtained for the electrode according to the invention which means lower cell voltage, and lower electric energy consumption. As can be further seen, the service life of the electrode of the invention is far better than the comparative electrode. The charge/projected area of the electrode of the invention was shown to be far larger than the comparative electrode, which results in increased service life and lower $Cl_2$ evolution (higher activity).

EXAMPLE 2

A second coating solution was prepared by mixing ruthenium chloride into a titanium solution comprising tetrabuthyl ortho titanate in n-butyl alcohol. 10 volume percent of HCl was added to the alcohol solution. The molar ratio of Ti:Ru was 2:1. The total Ru concentration was 40 g/l. An electrode with a first oxide layer prepared according to Example 1 was then coated with this second coating solution. The deposition and thermal decomposition was made in the same way as in Example 1. Chlorine potential and electrodouble layer measurements, according to Example 1, were then performed on the obtained electrode. Table 2 below shows the results of these measurements.

TABLE 2

| Sample | $Cl_2$ evolution potential (V vs NHE) | Cyclic voltammograms of the second (top) coating layer (mC/cm$^2$) |
|---|---|---|
| Electrode according to the invention | 1.35 | 570 |

As can be seen from a comparison of tables 1 and 2, a substantially lower $Cl_2$ evolution potential is obtained for the electrode according to the invention with only one platinum group-metal oxide in the second layer, which again means lower energy consumption. The charge/projected area of the obtained electrode is also substantially higher than the comparative electrode.

The invention claimed is:

1. A method of preparing an electrode comprising providing an electrode substrate, depositing on said electrode substrate a first substantially aqueous coating solution comprising precursors of a valve metal oxide and of at least two platinum group metal oxides, treating the first coating solution to provide a first metal oxide coating layer on the electrode substrate, depositing directly on said first coating layer a second substantially organic coating solution comprising precursors of a valve metal oxide and of at least one platinum group metal oxide, wherein at least one of the precursors is in organic form, treating said second coating solution to provide a second metal oxide coating layer directly on the first coating layer.

2. A method according to claim 1, wherein the precursors of the platinum group metal oxides comprise at least one soluble compound of iridium, palladium, platinum, rhodium, osmium, and ruthenium.

3. A method according to claim 1, wherein the precursor of the valve metal oxide is at least one soluble compound of aluminium, zirconium, bismuth, tungsten, niobium, titanium, silicon and tantalum.

4. A method according to claim 1, wherein the precursors of the platinum group metal oxides comprise one soluble ruthenium compound and at least one soluble compound of iridium, palladium, platinum, rhodium, and osmium.

5. A method according to claim 1, wherein the material of the electrode substrate comprises at least one valve metal of titanium, tantalum, zirconium, niobium, tungsten, and silicon.

6. A method according to claim 1, wherein the precursors of the platinum and valve metal oxides are dissolved in the coating solutions in a mole ratio of valve metal to platinum metal(s) of about 1:2 to about 2:1.

7. A method according to claim 1, wherein said organic form is selected from the group consisting of organic metal salts, organic metal acids and combinations thereof.

8. A method according to claim 1, wherein said at least one precursor in organic form is selected from the group consisting of titanium alcoxide, tetrabutyl titanate and tetrapentyl titante and combinations thereof.

9. An electrode obtained by providing an electrode substrate, depositing on said electrode substrate a first substantially aqueous coating solution comprising precursors of a valve metal oxide and of at least two platinum group metal oxides, treating the first coating solution to provide a first metal oxide coating layer on the electrode substrate, depositing directly on said first coating layer a second substantially organic coating solution comprising precursors of a valve metal oxide and of at least one platinum group metal oxide, wherein at least one of the precursors is in organic form, treating said second coating solution to provide a second metal oxide coating layer directly on the first coating layer.

10. An electrode comprising an electrode substrate, a first metal oxide coating layer having a charge/projected area from about from about 10 to about 200 mC/cm$^2$, said first coating layer comprising a valve metal oxide and at least two platinum group metal oxides deposited on said electrode substrate, and a second metal oxide coating layer having a charge/projected area from about 210 to about 1000 mC/cm$^2$ comprising a valve metal oxide and at least one platinum group metal oxide deposited directly on said first layer.

11. An electrode according to claim 10, wherein the platinum group metal oxides comprise at least one oxide of iridium, platinum, palladium, rhodium, osmium, and ruthenium.

12. An electrode according to claim 10, wherein the platinum group metal oxide is selected from ruthenium oxide and at least one oxide of iridium, platinum, palladium, rhodium, and osmium.

13. An electrode according to claim 10, wherein the charge/projected area of the first coating layer is from about 25 to about 200 $mC/cm^2$.

14. An electrode according to claim 10, wherein the charge/projected area of the first coating layer is from about 25 to about 190 $mC/cm^2$.

15. An electrode according to claim 10, wherein the charge/projected area of the second coating layer is from about 250 to about 1000 $mC/cm^2$.

16. An electrode according to claim 10, wherein the charge/projected area of the first coating layer is from about 300 to about 800 $mC/cm^2$.

17. Process of electrolytic production in an electrolytic cell in which an electrode as defined in claim 10 is arranged.

18. An electrode according to claim 10, wherein the charge/projected area of the second coating layer is from about 300 to about 800 $mC/cm^2$.

* * * * *